US007762935B2

(12) United States Patent
Doble et al.

(10) Patent No.: US 7,762,935 B2
(45) Date of Patent: Jul. 27, 2010

(54) EXERCISE APPARATUS RESISTANCE UNIT

(76) Inventors: William C. Doble, 110 Towers Rd., Essex Junction, VT (US) 05452; David J. Dodge, 44 Goldenrod La., Williston, VT (US) 05495

( * ) Notice: Subject to any disclaimer, the term of this patent is extended or adjusted under 35 U.S.C. 154(b) by 173 days.

(21) Appl. No.: 11/595,753

(22) Filed: Nov. 10, 2006

(65) Prior Publication Data

US 2007/0054790 A1 Mar. 8, 2007

Related U.S. Application Data

(63) Continuation-in-part of application No. 10/370,975, filed on Feb. 20, 2003, now Pat. No. 7,291,100.

(51) Int. Cl.
*A63B 21/02* (2006.01)

(52) U.S. Cl. ..... 482/121; 482/122

(58) Field of Classification Search ..... 482/121–122, 482/129, 128, 127, 130
See application file for complete search history.

(56) References Cited

U.S. PATENT DOCUMENTS

| | | | | | |
|---|---|---|---|---|---|
| 9,695 | A * | 5/1853 | Hinsdale | 482/144 |
| 2,763,156 | A * | 9/1956 | Garigal | 73/379.08 |
| 4,072,309 | A | 2/1978 | Wilson | |
| 4,231,568 | A * | 11/1980 | Riley et al. | 482/130 |
| 4,426,077 | A * | 1/1984 | Becker | 482/92 |
| 4,620,704 | A * | 11/1986 | Shifferaw | 482/130 |
| 4,684,125 | A * | 8/1987 | Lantz | 482/112 |
| 4,725,057 | A | 2/1988 | Shifferaw | |
| 4,838,236 | A * | 6/1989 | Kudlacek | 124/25.6 |
| 4,863,159 | A * | 9/1989 | Brown, Jr. | 482/126 |
| 4,988,095 | A * | 1/1991 | Ferrari | 482/102 |
| 5,005,832 | A * | 4/1991 | Van Der Hoeven | 482/124 |
| 5,123,886 | A * | 6/1992 | Cook | 482/129 |
| 5,336,142 | A * | 8/1994 | Dalebout et al. | 482/52 |
| 5,755,649 | A * | 5/1998 | Bimby | 482/126 |
| 5,820,529 | A * | 10/1998 | Weintraub | 482/92 |
| 6,082,346 | A * | 7/2000 | Andrews et al. | 124/25.6 |
| 6,443,139 | B1 * | 9/2002 | McPherson | 124/25.6 |
| 6,652,429 | B2 * | 11/2003 | Bushnell | 482/128 |
| 6,685,607 | B1 * | 2/2004 | Olson | 482/142 |
| 6,726,601 | B1 * | 4/2004 | Beutel | 482/52 |
| 7,250,022 | B2 * | 7/2007 | Dalebout et al. | 482/142 |
| 7,309,303 | B1 * | 12/2007 | Proctor | 482/121 |
| 7,429,236 | B2 * | 9/2008 | Dalebout et al. | 482/123 |
| 7,537,552 | B2 * | 5/2009 | Dalebout et al. | 482/129 |
| 2002/0077229 | A1 * | 6/2002 | McBride | 482/130 |
| 2003/0144071 | A1 | 7/2003 | Dodge | |
| 2004/0166999 | A1 | 8/2004 | Dodge | |
| 2004/0259700 | A1 * | 12/2004 | Stewart et al. | 482/122 |
| 2005/0037904 | A1 * | 2/2005 | Chang et al. | 482/122 |
| 2005/0101457 | A1 * | 5/2005 | Tuller | 482/128 |
| 2007/0032356 | A1 * | 2/2007 | Rief | 482/130 |
| 2007/0093366 | A1 * | 4/2007 | Zuckerman | 482/121 |

* cited by examiner

*Primary Examiner*—Loan H Thanh
*Assistant Examiner*—Sundhara M Ganesan

(57) ABSTRACT

An exercise apparatus resistance unit includes flex members to bend to provide a resistance, a first end piece, a second end piece provided another end of the flex members to secure the flex members to rotate and translate within the body according to a bending motion of the flex members, a main pulley, and auxiliary pulleys rotatably provided on the first end piece. The resistance unit may provide a variable resistance.

20 Claims, 11 Drawing Sheets

EXERCISE APPARATUS RESISTANCE UNIT

CROSS REFERENCE TO RELATED APPLICATIONS

This application is a continuation in part from application Ser. No. 10/370,975 filed Feb. 20, 2003.

BACKGROUND OF THE INVENTION

1. Field of the Invention

The present general inventive concept relates to an exercise apparatus resistance unit, and more particularly, to an exercise apparatus resistance unit that is provided with resilient flexural tubes to provide resistance to a user.

2. Description of the Related Art application Ser. No. 10/370,975 relates to a resistance unit having one or more pulleys on each end. One or more cables are provided across the pulleys and the resistance unit. A force is applied to either end of the cables to deflect the resilient panel. The resistance unit can be a resilient panel or tubular structural members. In addition, the resilient panel can be reinforced with the tubular structural members.

The force applied to the resilient panel through the pulleys provides a bending force to bend the resilient panel. The resilient panel has an original orientation, an elastic resistance, and an elastic memory so that the resilient panel bends from the original orientation when the bending force and a compressive load is applied and where the elastic memory allows the resilient panel to substantially return to the original orientation when the bending force is removed. The pulleys are located at each end of the resilient panel, and are arranged so that the respective pulleys on each end of the resilient panel share the same axis of rotation and are each offset from the plane of the resilient panel. The cable runs from pulley to pulley in a tackle arrangement where each end of the cable emerges from a pulley at the other end of the resilient panel, so that when the ends of the cable are pulled, resistance is generated by applying the bending moment and the compressive load to the opposing ends of the resilient panel. The resilient panel has an adjustable level of resistance.

application Ser. No. 10/351,307 relates to sports equipment having a tubular structural member. The tubular structural member can have variable resistance with respect to a bending plane of the tubular structural member.

Prior art exercise equipment have other methods to convert a free weight or other free standing methods of resistance into a useful means of resistance for exercise equipment. Resistance is achieved by providing a mechanical advantage to lower the mass required. U.S. Pat. No. 4,072,309 teaches the use of a circular elastic cord to provide resistance. U.S. Pat. No. 5,603,678 includes elastomeric weight straps in addition to the use of dead weight as a resistance device. U.S. Pat. No. 4,620,704 and U.S. Pat. No. 4,725,057 each teaches the use of resilient rods as a means of providing resistance.

Other examples of the prior art include resistance devices based on hydraulic systems such as those described in U.S. Pat. No. 3,834,696 and U.S. Pat. No. 4,148,479. U.S. Pat. No. 3,955,655 teaches fluid based resistance exercise devices. Similarly, U.S. Pat. No. 3,944,221 teaches resistance methods based on the use of air cylinders. U.S. Pat. No. 4,333,645 and U.S. Pat. No. 3,638,941 each teaches the use of springs as resistive devices.

Another consideration for the design of exercise machines is the ability to change the level of resistance to suit the particular user and the exercise being performed. When a dead weight method of resistance is used the user must stop the exercise routine to change the amount of weight desired. In the simplest, barbell type system, this requires the user to stop the exercise and physically affix or remove the dead weight on the bar before resuming his workout. Prior art, such as U.S. Pat. No. 3,647,209 teaches a system of cables, pulleys and deadweight to achieve resistance, whereby the movement of pins engages or disengages the desired weights onto the lifting device. However, this type of system also requires that the user stop the exercise and frequently move to a new position to affect the change in weight resistance.

U.S. Pat. No. 4,072,309 adjusts the level of resistance in an exercise apparatus through elastomeric weight straps which requires the user to also stop the exercise and physically move to a new position to affect the change in weight resistance by changing the elastic band and/or adding or removing auxiliary dead weights.

The resilient rod method of resistance as found in U.S. Pat. No. 4,620,704 and U.S. Pat. No. 4,725,057 require the user to also stop the exercise and physically move to a new position to affect the change in weight resistance by changing the number or type of resistance rods that are connected by cable to the exercise apparatus. It is therefore inconvenient for the user to effectively adjust the resistance of the exercise apparatus.

SUMMARY OF THE INVENTION

The present general inventive concept provides an exercise apparatus resistance unit having resilient flexural tubes to provide resistance to a user.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing an exercise apparatus, including a body and a resistance unit to provide a resistance, the resistance unit includes flex members to bend to provide the resistance, a first end piece provided on one end of the flex members to rotatably secure the one end of the flex members to the body, a second end piece provided another end of the flex members to secure the flex members to rotate and translate within the body according to a bending motion of the flex members, a main pulley provided on the second end piece to rotate with respect to the second end piece, and auxiliary pulleys rotatably provided on the first end piece.

The foregoing and/or other aspects and utilities of the present general inventive concept may also be achieved by providing a resistance unit, including one or more flex members arranged in a planar direction to have a bending resistance when compressed, pulleys provided on each end of the one or more flex members, the pulleys on each of the ends of the one or more flex members with an axis of rotation offset from a plane formed by the one or more flex members, and a cable provided across the one or more flex members to each of the pulleys to apply a compressive load to the one or more flex cables when the cable is pulled.

The foregoing and/or other aspects and utilities of the present general inventive concept may be achieved by providing a resistance unit, including one or more flex members arranged in a planar direction to have a bending resistance when compressed, a first end piece provided on a first end of each of the one or more flex members to secure each of the first ends in a planar direction, a second end piece provided on a second end of each of the one or more flex members to secure each of the second end in the planar direction, first end pulleys provided on the first end piece, second end pulleys on the second end piece, and a cable to connect the first end pulleys and the second pulleys to provide a compressive load to the one or more flex members when the cable is pulled.

The one or more flex members may be tubular structural members that have a directionally variable resistance. The resistance unit may also include a tube rotation device to rotate the tubular structural members to change the bending resistance.

BRIEF DESCRIPTION OF THE DRAWINGS

These and/or other aspects and utilities of the present general inventive concept will become apparent and more readily appreciated from the following descriptions of the embodiments, taken in conjunction with the accompanying drawings of which.

DETAILED DESCRIPTION OF THE PREFERRED EMBODIMENTS

Figure 1:
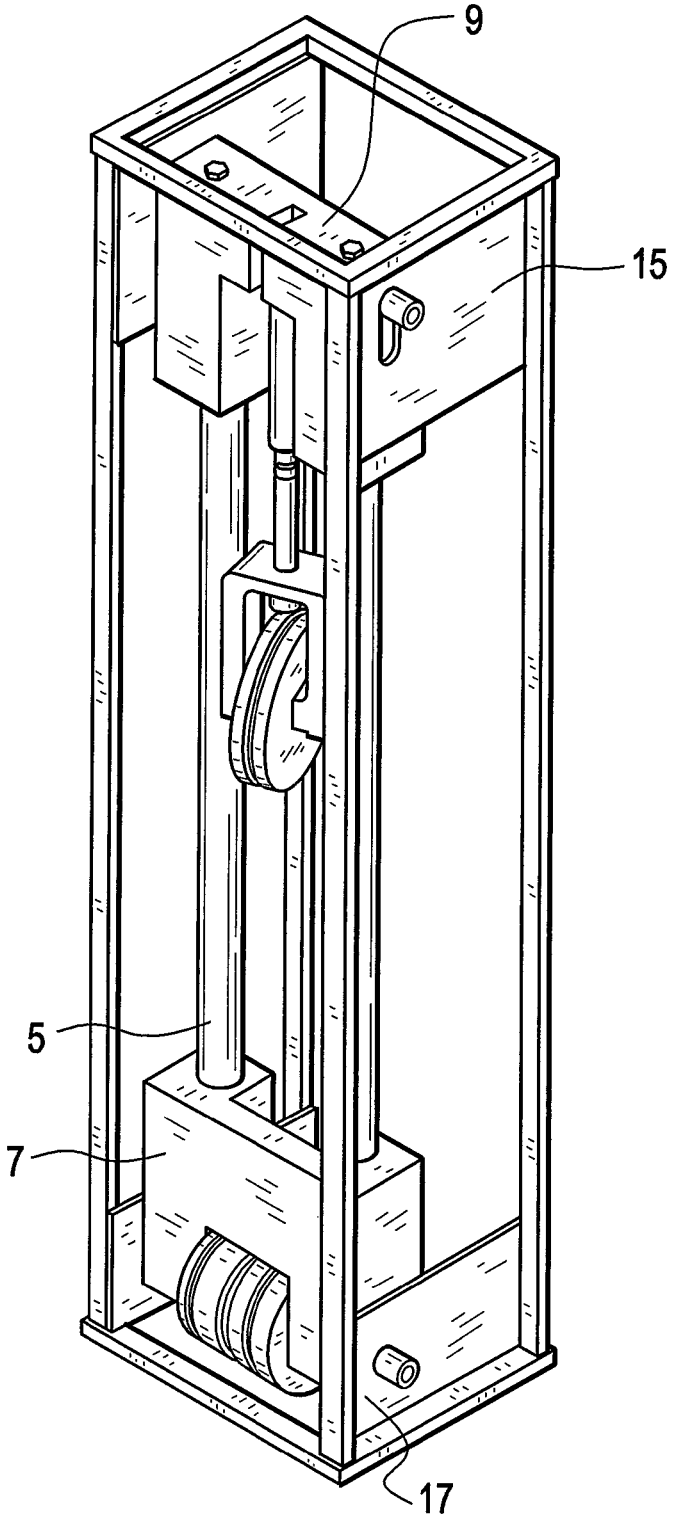
FIG. 1 is a view illustrating an exercise apparatus resistance unit and frame according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

An exercise apparatus resistance unit includes flexural resistance spines to supply resistance to a user of the exercise machine. The flexural resistance spines allow the user to exercise effectively when deflected. In different embodiments of the exercise apparatus, the flexural resistance spines can be attached to the exercise equipment depending on the configuration of the particular exercise equipment. Thus, the flexural resistance spines can be used in many different types of exercise machines and can be arranged in different orientations within a particular exercise machine. Additionally, in different embodiments of the exercise apparatus, the resistance of flexural resistance spines can be adjusted to provide the user with a customized workout. Furthermore, the resistance of the flexural resistance spines can be adjusted without interfering with the progress of the exercise.

The flexural resistance spines provide resistance by elastically resisting being deflected about an axis. Each of the flexural resistance spines deflects in one direction and then returns to its original orientation. While deflected, the flexural resistance spines elastically store the energy used to deflect it. The flexural resistance spines can be deflected by applying a combination of a bending moment and compressive load to the opposing ends of the flexural resistance spines. The combination of a bending moment and compressive load to the opposing ends of the resistance unit can be accomplished by an assembly consisting of cables and pulleys.

According to an embodiment of the present general inventive concept, the cables can include a tension cable and an output cable and the pulleys may include a first pulley assembly and a second pulley. The first pulley assembly may include one or more pulley drums rotatably provided on a common shaft. The first pulley assembly includes a first pulley drum, a second pulley drum, and a third pulley drum. The first, second, and third pulley drums are rotatably provided on an end of the resistance unit. The second pulley is rotatably provided on an opposite end of the resistance unit from the first pulley assembly. The tension cable starts wrapped around the first pulley drum and the tension cable then goes around the second pulley. The tension cable then connects to the second pulley drum.

The tension cable forms a loop between the first pulley assembly and the second pulley. The second pulley drum is larger than the first and third pulley drums. The output cable, which may be an extension of the tension cable, is attached at one end to the third pulley drum. As the output cable is pulled, the output cable unwinds and rotates the first and third pulley drums, thus causing the output cable to unwind off the first pulley drum, go around the second pulley and wind onto the second pulley drum, thus shortening the loop between the first pulley assembly and the second pulley. By shortening the loop between the first pulley assembly and the second pulley, the two ends of the resistance unit are pulled closer together. However, a single cable may be employed and the first pulley assembly may include two or more pulley drums. By adjusting the ratio of the diameter of the first and third pulley drums and the second pulley drum, a mechanical advantage from the pulleys may vary from close to infinity to approximately 1 to 1.

In an embodiment of the present general inventive concept, multiple pulleys are positioned parallel to one another at each end of the resilient panel. In one embodiment of the present general inventive concept, the pulleys have axes of rotation that are offset from a plane defined by the flexural resistance spines. In other embodiments, the pulleys may be provided on the plane of the flexural resistance spines. Additional embodiments can have more than one cable.

The action of pulling the cable to apply the compressive load to the opposing ends of the flexural resistance spines shall be referred to as "stroke". In addition, the term "tackle" is used to describe the pulleys connected by a cable that engages the pulleys. Flexural resistance spines that have a nearly-constant level of resistance output throughout the stroke can be achieved by taking into account the amount of offset of the pulleys perpendicular from an end of the flexural resistance spines (countering the increased bending resistance of the panel as it deflects); by adjusting the relative diameters of the respective pulleys; the offset of the pulleys from the flexural resistance spines parallel to the direction of the bending; and the dimensions and stiffness properties of the flexural resistance spines itself. In other embodiments of the present general inventive concept, the stiffness properties of the flexural resistance spines can also be affected by an orientation of the flexural resistance spines with respect to the bending direction.

Because the exercise apparatus resistance unit derives the resistance from the flexural resistance spines, the exercise apparatus does not depend upon gravity to generate the resistance. Accordingly, the exercise apparatus resistance unit may be used in any position. The exercise apparatus can be provided in many orientations so as to provide the resistance to a user. In addition, different embodiments can allow different size bars to be attached to the cables to deliver different types of exercise. Thus, the free ends of the cable or cables may be attached to different exercise attachments so that the exercise apparatus transmits the force to the cable in order to compress the flexural resistance spines.

The flexural resistance spines can be constructed of PVC, ABS or other material with the proper stiffness characteristics, including fiberglass and metal. The use of PVC allows for easy and cheap construction of the tubes. A long tube with guides and grooves can be manufactured and then cut into equal lengths, and then be arranged into the exercise apparatus. By rotating the flexural resistance spine within the exercise apparatus, the flexural resistance spines' resistance to bending can be changed.

According to an embodiment of the present general inventive concept, the flexure resistance spines would be rotated to and secured in a desired stiffness position. In other embodiments, motors, timers, computers, and the like are employed to rotate the flexure resistance spines. The use of the motors makes changes to the flexural resistance spine's stiffness automatic and eliminates the need for the user to effect a manual change of stiffness adjustment. Accordingly, the flexural resistance spines can change resistance during the exercise without requiring the exercise to stop. The computer can also be connected to a display to indicate the amount by which the flexure resistance spines are rotated.

The flexural resistance spines can have pulleys attached at the ends of the flexural resistance spines. Additionally, the pulleys can be attached to the flexural resistance spines in manner where a pulley is connected to one or more flexural resistance spines.

FIG. 1 is a view illustrating an exercise apparatus resistance unit 1 according to an embodiment of the present general inventive concept. Referring to FIG. 1, the exercise apparatus resistance unit 1 includes flexural resistance spines 5 housed therein. The flexural resistance spines 5 are planar with each other. First end piece 7 and second end piece 9 are located at opposite ends of each of the flexural resistance spines 5 to secure and bend the flexural resistance spines 5. The flexural resistance spines may also include flex members or tubular structural members.

Figure 2:
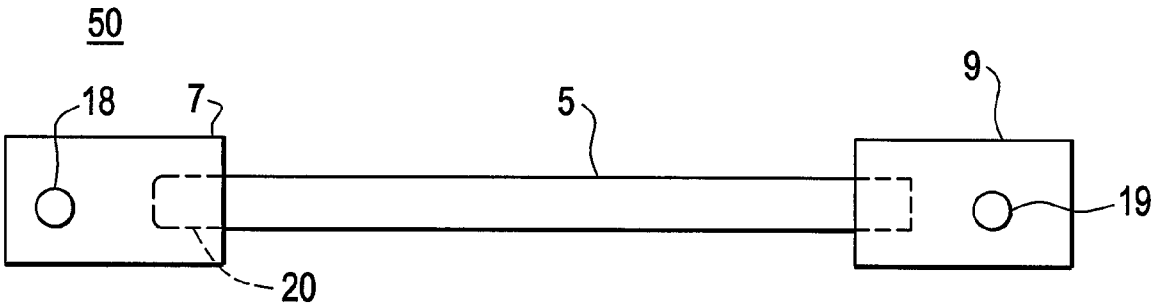
FIG. 2 is a side view illustrating a resistance unit of the exercise apparatus resistance unit of FIG. 1.

FIG. 2 is a side view illustrating a resistance unit 50 of the exercise apparatus resistance unit 1 of FIG. 1. Referring to FIG. 2 the resistance unit 50 of the exercise apparatus resistance unit 1 includes the flexural resistance spines 5 and the first and second end pieces 7 and 9. The first and second end pieces 7 and 9 each have a first axle slot 18 and a second axle slot 19 respectively defined therein. A first axle 10 and second axle 11 are each received within the respective first and second axle slots 18 and 19. The flexural resistance spines 5 are received within the first and second end pieces 7 and 9 to secure the flexural resistance spines 5.

Figure 3:
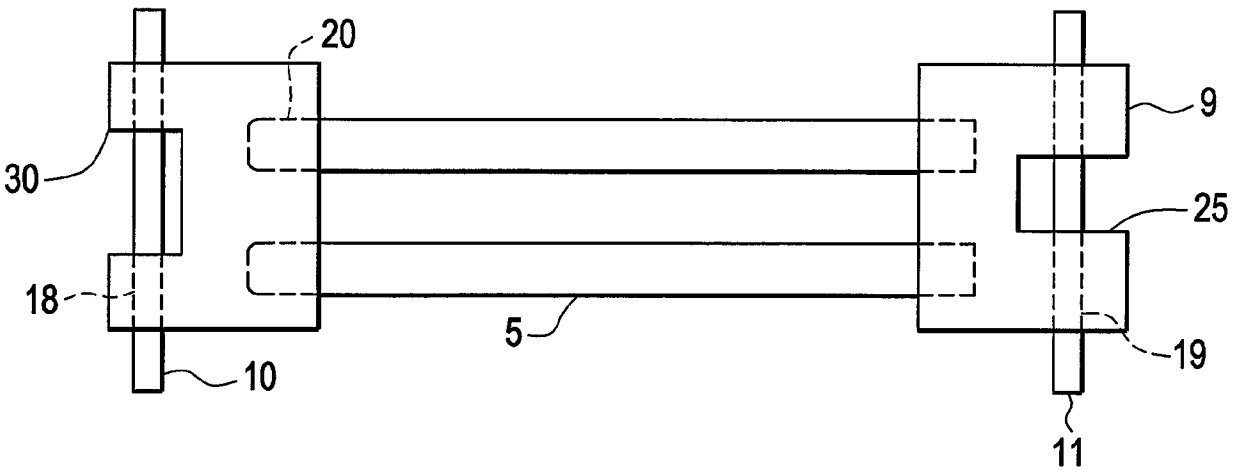
FIG. 3 is a front view illustrating the resistance unit.

FIG. 3 is a front view illustrating the resistance unit 50. Referring to FIG. 3, the first and second axles 10 and 11 are received through the first and second axle slots 18 and 19 in a direction perpendicular to the flexural resistance spines 5. However, in other embodiments, the axles and first and second axle slots 18 and 19 may secure the first and second end pieces 7 and 9 in other orientations with respect to the flexural resistance spines 5.

Referring to FIG. 1, the first and second axles 10 and 11 secure the first and second end pieces 7 and 9, respectively, within the exercise apparatus 1. The first end piece 7 is secured in a first hole 17 defined in the exercise apparatus 1 via the first axle 10 to secure the first end piece with respect to the exercise apparatus but to allow the first end piece to pivot within the exercise apparatus 1 about the axle 10. The second end piece 9 is placed within the exercise apparatus in a second slot 15 defined in the exercise apparatus 1. The second slot 15 is defined within the exercise apparatus 1 to allow the second axle 11 to translate with respect to the exercise apparatus as the flexural resistance spines 5 deflect.

Figure 4:
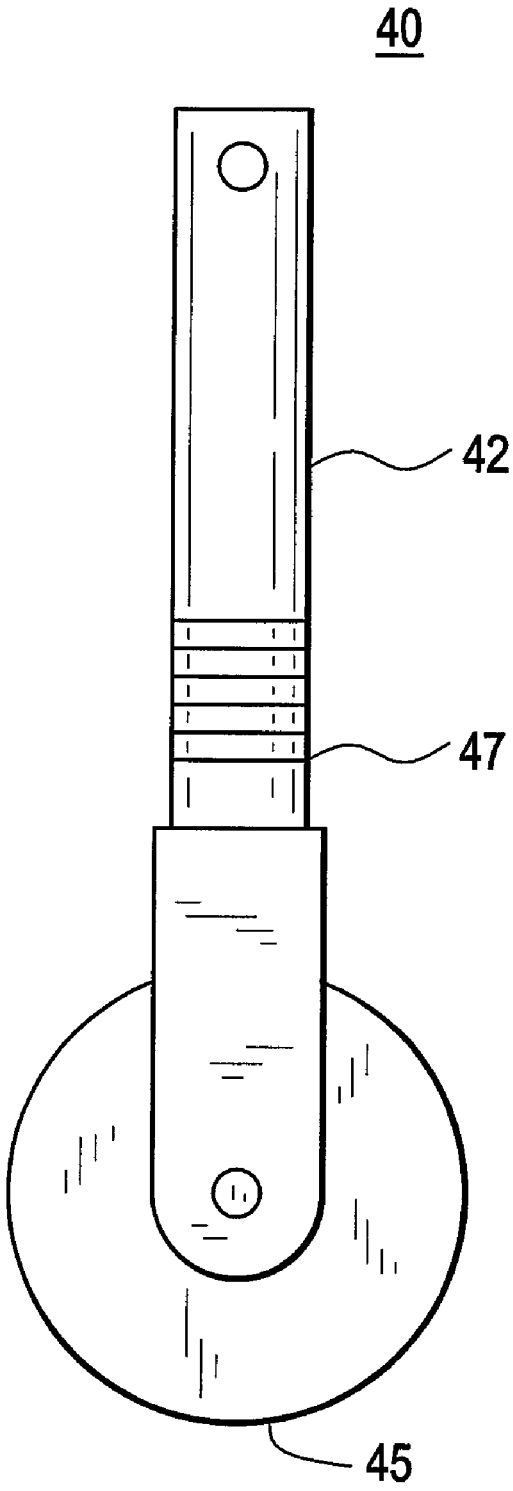
FIG. 4 is a view illustrating a main pulley assembly of the exercise apparatus resistance unit of FIG. 1.

Referring to FIG. 3, the second end piece 9 has a main pulley receiving slot defined therein 25. The first end piece 7 has a secondary pulley slot 30 defined therein. FIG. 4 is a view illustrating a main pulley assembly 40 of the exercise apparatus 1 of FIG. 1. One or more secondary pulleys 35 are received within the secondary pulley slot 30. The secondary pulleys 35 may rotate around and be supported by the first axle 10.

Referring to FIGS. 3 and 4, the main pulley assembly 40 includes a main pulley 45 and a pulley arm 42. The main pulley 45 is provided at one end of the pulley arm 42. The main pulley assembly 40 is connected to the second end piece 9 at the main pulley receiving slot 25. The pulley arm 42 may be secured by the second axle 11. The pulley arm may also include a length adjuster 47 to adjust the length of the pulley arm 42.

Figure 5:
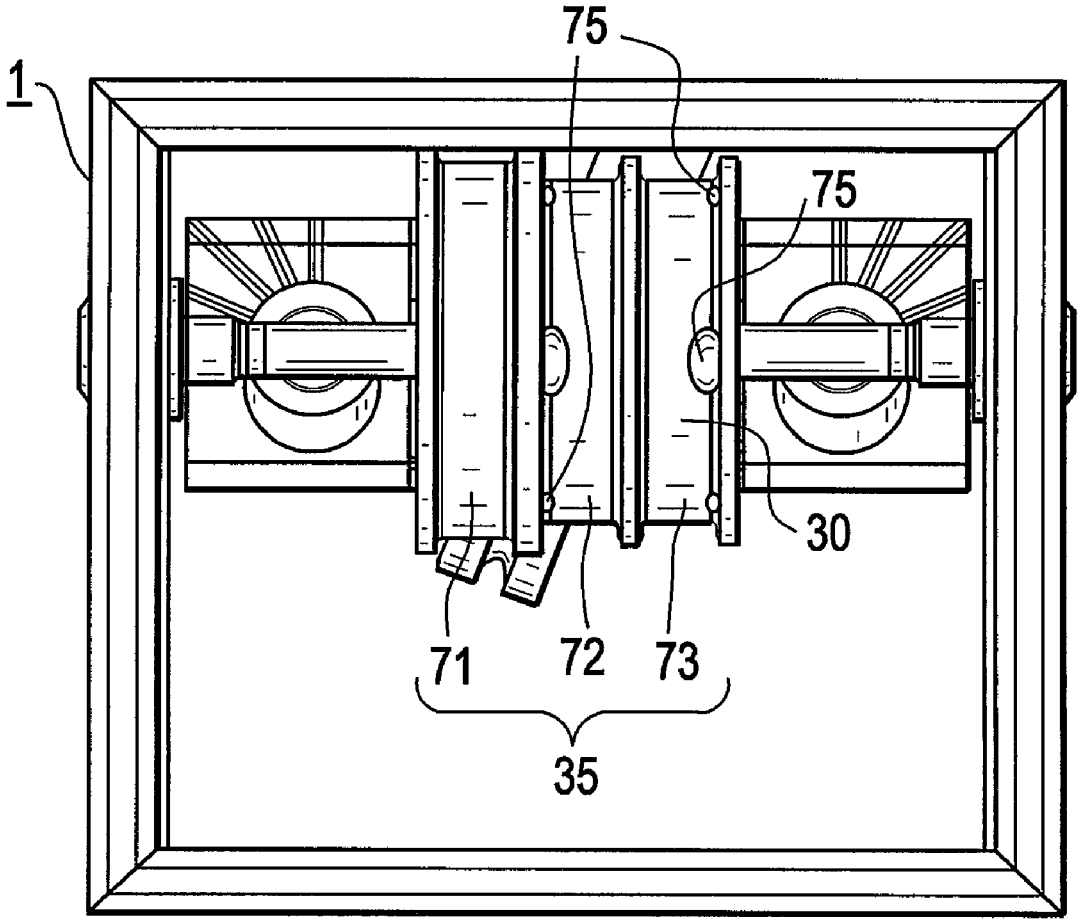
FIG. 5 is a bottom view of an secondary pulleys of the exercise apparatus.

FIG. 5 is a bottom view of secondary pulleys 35 of the exercise apparatus 1. Referring to FIG. 5, the secondary pulleys may include a first pulley drum 71, a second pulley drum 72, and a third pulley drum 73. A cable (not illustrated) can be threaded from the main pulley 40 and the first, second, and third pulley drums 71, 72, 73 of the secondary pulleys 35 and to the exercise apparatus 1 to provide a force input to the first pulleys 25 and the main pulley 45 and, thus, to the flexural resistance spines 5. Therefore, the cable provides the resistance force from the user to the flexural resistance spines 5 to create an exercise motion.

The first, second, and third pulley drums 71, 72, and 73 can rotate independently of each other about the first axle 10. Each of first, second, and third pulleys 71, 72, and 73 may also include cable slots defined therein to provide a fixture location for the cable.

Figure 6:
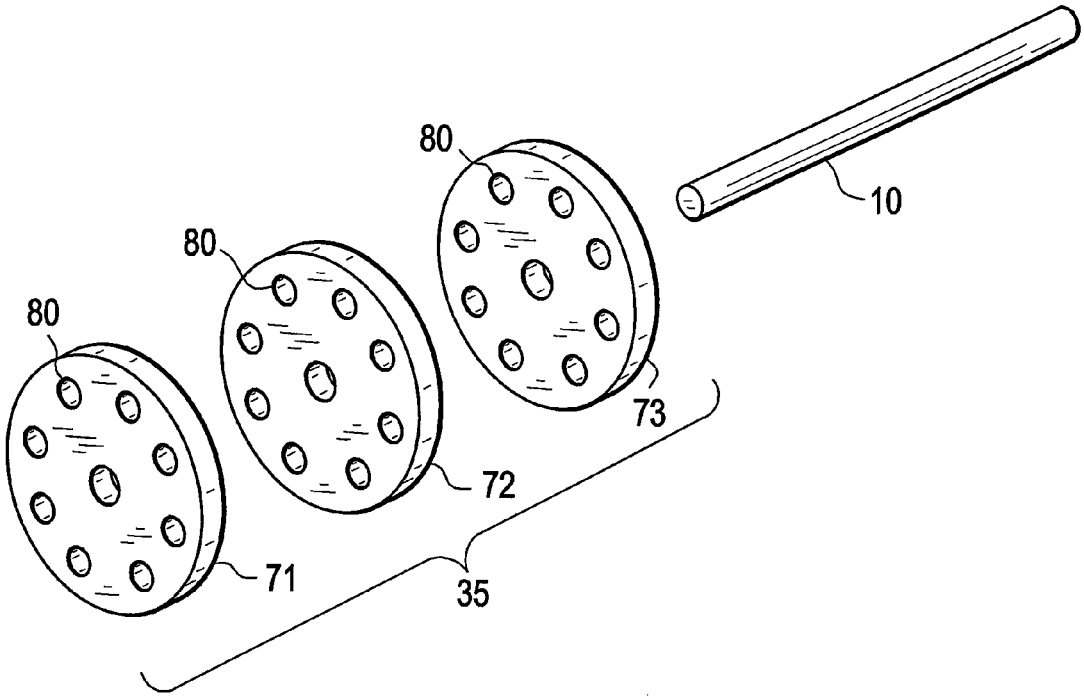
FIG. 6 is an exploded view of first, second, and third pulley drums of the secondary pulleys.

FIG. 6 is an exploded view of the first, second, and third pulley drums 71, 72, and 73 of the secondary pulleys. Referring to FIG. 6, the first, second, and third pulley drums 71, 72, and 73 each have one or more lock holes 80 defined therein to secure each of the adjacent first, second, and third pulleys 71, 72, and 73 together. Therefore, the pulleys can be rotated separately and then secured together to pretension the cable.

Figure 7:
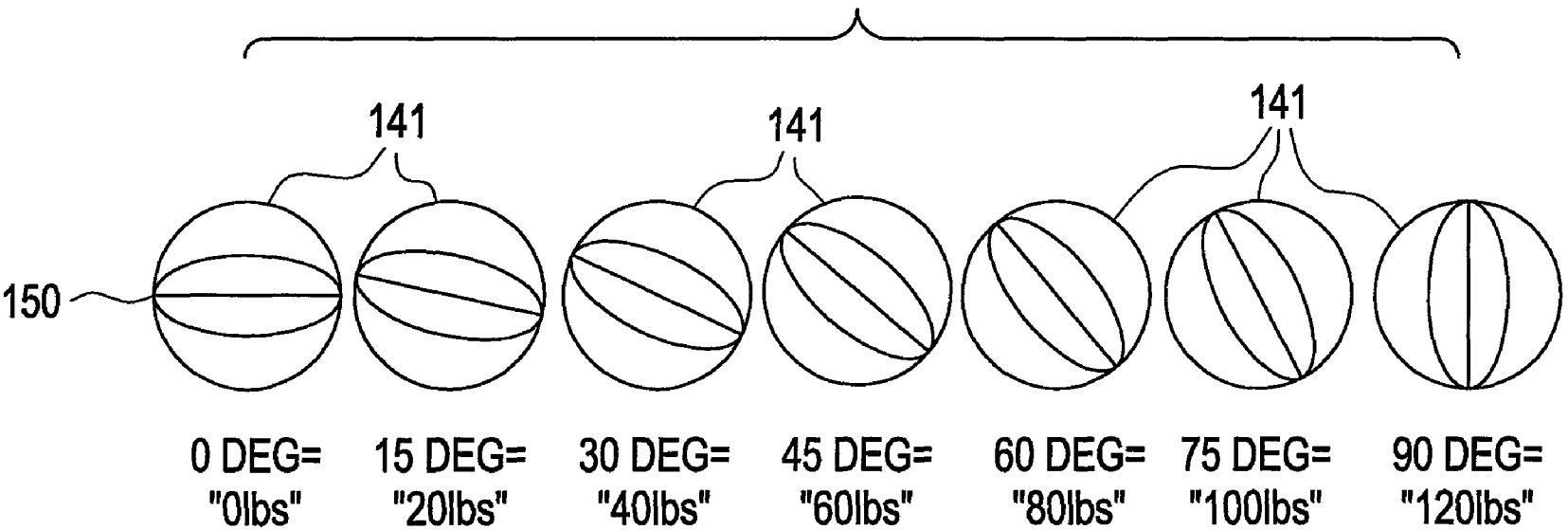
FIG. 7 is a diagram illustrating a bending resistance of a directional resistance spine according to an embodiment of the present general inventive concept.

FIG. 7 is a diagram illustrating a bending resistance of a directional resistance spine 141 according to an embodiment of the present general inventive concept. Referring to FIG. 7, the directional resistance spine 141 delivers a bending resistance depending on the orientation of the directional resistance spine 141 and the direction of bending. In one embodiment of the present general inventive concept, the directional resistance spine has a core material 150 that is aligned within the directional resistance spine 141 to provide a directional bending resistance to the directional resistance spine 141. In FIG. 7, the amount of force resisting the bending force differs as the directional resistance spine is rotated with respect to the bending direction. At 0 degrees, when the directional resistance spine 141 is aligned parallel to the bending direction, the bending resistance is minimal. At 90 degrees, when the directional resistance spine 141 is perpendicular to the bending direction, the bending resistance is maximal.

Figure 8:
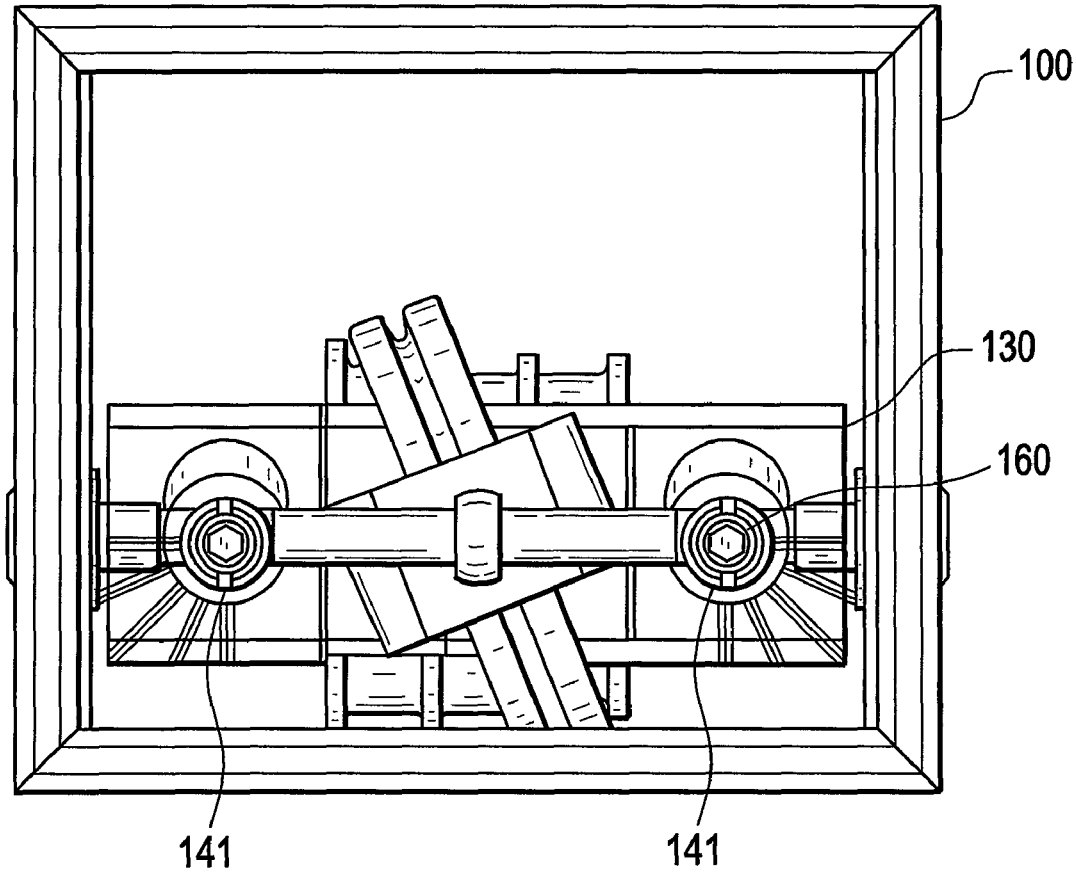
FIG. 8 is a top view illustrating an adjustable resistance unit according to an embodiment of the present general inventive concept.
Figure 9:
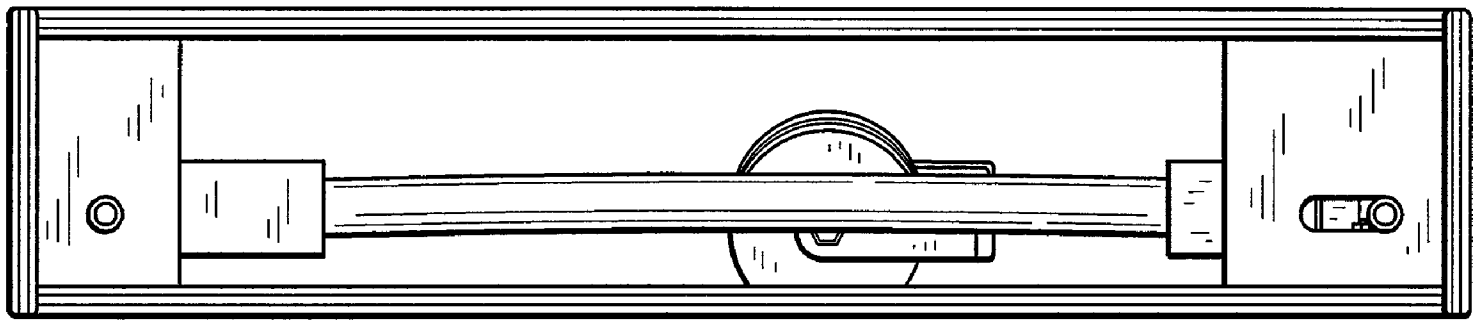
FIG. 9 is a side view illustrating the exercise unit resistance unit at minimum deflection.
Figure 10:
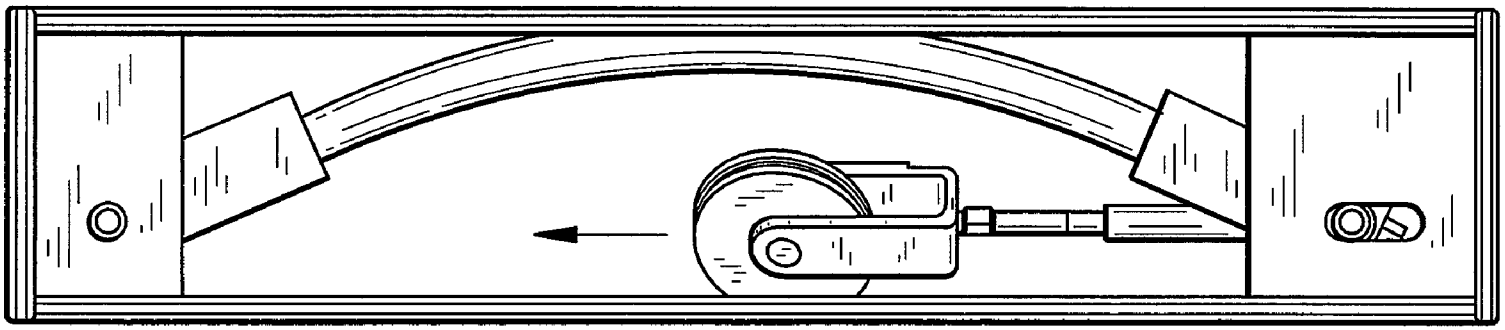
FIG. 10 is a side view illustrating the exercise unit resistance unit at maximum deflection.

FIG. 8 is a top view illustrating an adjustable exercise unit 100 according to an embodiment of the present general inventive concept. Referring to FIG. 8, the adjustable exercise apparatus 100 includes a second end piece 130, a first end piece (not illustrated) and the directional resistance spines 141. The second end piece 130 includes a spinal direction changer 160 for each other the directional resistance spines 141. The spinal direction changers 160 rotate the directional resistance spines 141 to change the resistance of the directional resistance spines 141 with respect to the bending direction to provide a varied resistance to the adjustable exercise apparatus 100. In other embodiments of the present general inventive concept, either the first end piece or the second end piece can control the rotation of the directional resistance spines 141.

Figure 11:
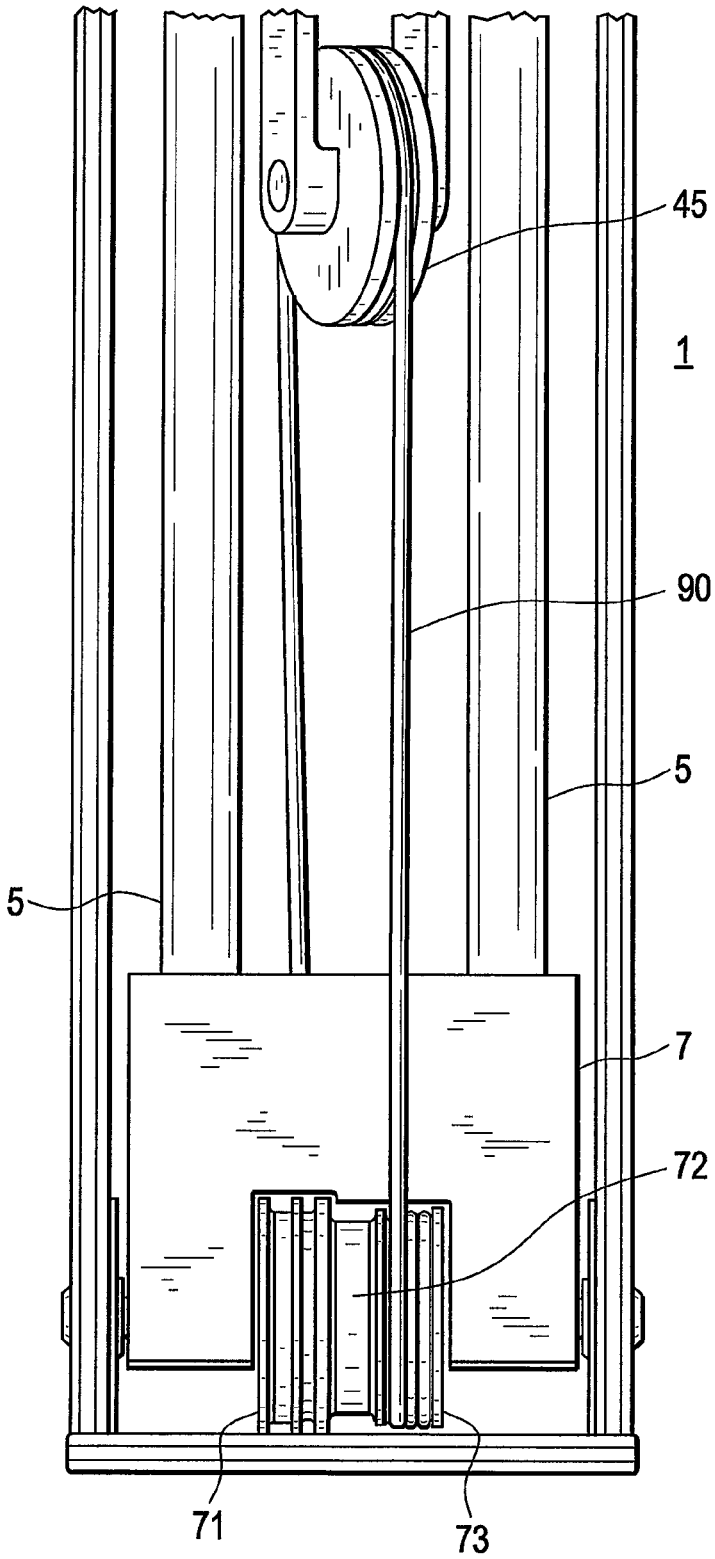
FIG. 11 is a front view illustrating a cable of the exercise apparatus resistance unit.

FIG. 11 is a front view illustrating a cable 90 of the exercise apparatus resistance unit 1. Referring to FIG. 11, the exercise apparatus resistance unit 1 includes the cable 90. The cable 90 runs from the first pulley drum 71 to the main pulley 45 and to the third pulley drum 73. In an embodiment of the present general inventive concept, the cable 90 runs from the third pulley drum 73 to the second pulley drum 72 and then away from the exercise apparatus resistance unit 1. That is, a loop is formed between the first pulleys 35 and the main pulley 45. From the exercise apparatus resistance unit 1, the cable 90 can be pulled to tension the cable 90 and tighten the loop to compress the resistance unit 50 and provide resistance as the as the flexural resistance spines 5 bend when each of the first pulleys rotate together (when locked together). In another embodiment of the present general inventive concept, the cable 90 ends at the third pulley drum 73 and a second cable (not illustrated) is provided on the second pulley drum 72 to rotate the second pulley drum 72 when the second cable is pulled, thus rotating the first pulleys 35 together (when the first, second, and third pulley drums 71, 72, and 73 are locked together). When the first, second, and third pulley drums 71, 72, and 73 are not locked together, they may be rotated as desired to tension the cable 90 and the exercise apparatus resistance unit 1.

Figure 12:
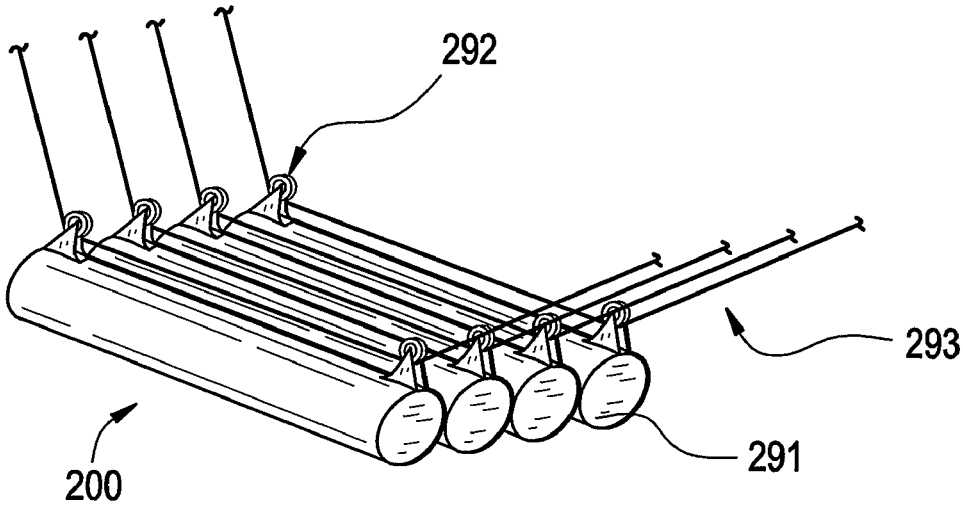
FIG. 12 is a view illustrating a resistance unit according to an embodiment of the present general inventive concept.

FIG. 12 is a view a resistance unit 200 according to an embodiment of the present general inventive concept. Referring to FIG. 12, the resistance unit includes flexural resistance spines 291, pulleys 292, and cables 293. The pulleys 292 are attached to the ends of the flexural resistance spines 291. The pulleys 292 have axes of rotation apart from a plane formed by the flexural resistance spines 291. The cables 293 are threaded between the cables to transfer force from a user to the resistance unit 200. The flexural resistance spines 291 may have a variable resistance.

Figure 13:
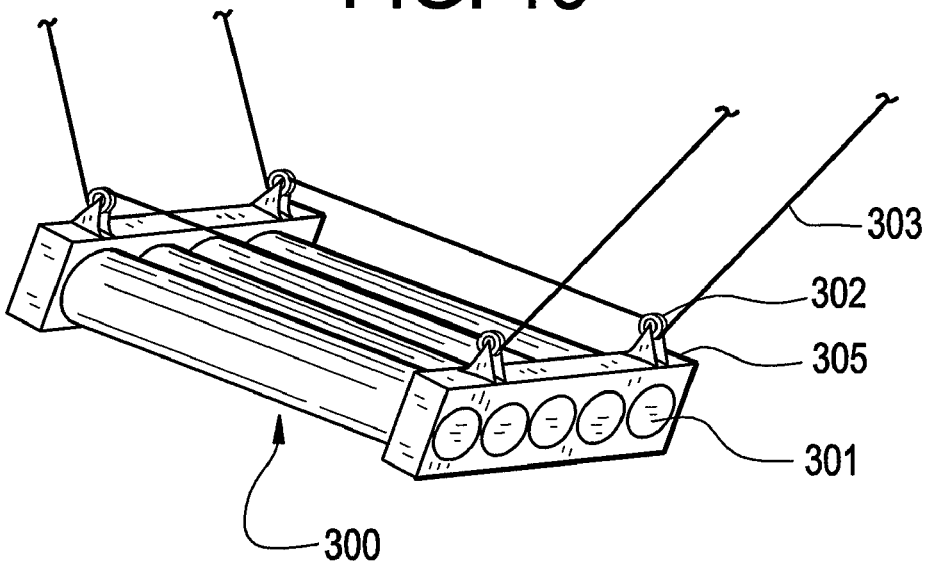
FIG. 13 is a view illustrating a resistance unit according to another embodiment of the present general inventive concept.

FIG. 13 is a view illustrating a resistance unit 300 according to another embodiment of the present general inventive concept. Referring to FIG. 13, the resistance unit 300 includes flexural resistance spines 301, end pieces 305, and pulleys 302. The end pieces 305 are provided on each end of the flexural resistance spines 301. The pulleys 302 are provided on each of the end pieces 305. The end piece 305 is able to transmit the force from the cables 303. The flexural resistance spines 301 may have a variable resistance.

We claim:

1. An exercise apparatus, comprising:

a body;

a resistance unit to provide a resistance, the resistance unit comprising:

flex members to bend to provide the resistance;

a first end piece provided on an end of each of the flex members to rotatably secure the one end of the flex members to the body;

a second end piece provided at an other end of each of the flex members to secure the flex members to rotate and translate within a guide area defined in the body to guide the second end piece in a direction of a lateral translation of the second end piece according to a bending motion of the flex members;

a main pulley provided on the second end piece to rotate with respect to the second end piece; and auxiliary pulleys rotatably provided on the first end piece.

2. The exercise apparatus of claim 1, further comprising a first cable and a second cable, wherein:

the auxiliary pulleys comprise a first pulley drum, a second pulley drum, and a third pulley drum, the first, second, and third pulley drums each sharing an axis of rotation;

the first, second, and third pulley drums to selectively rotate together;

the first cable runs between the auxiliary pulleys and the main pulley to form a loop therebetween, the first cable to run from the first pulley drum to the main pulley to the second pulley drum to close the loop when the cable is pulled in a first direction and to open the loop when the cable is pulled in a second direction; and the second cable is provided on the third pulley drum to rotate the auxiliary pulleys when the first, second, and third pulley drums are selected to rotate together.

3. The exercise apparatus of claim 2, wherein the first and third pulley drums have a first diameter and the second pulley drum has a second diameter to create a mechanical advantage.

4. The exercise apparatus of claim 2, wherein:

the auxiliary pulleys comprise a pulley body having first pulley diameter, a second pulley diameter, and a third pulley diameter;

the cable runs between the auxiliary pulleys and the main pulley to form a loop therebetween, the cable to run from the first pulley diameter to the main pulley to the second pulley diameter; and the cable runs to the third pulley diameter to rotate the pulley body.

5. The exercise apparatus of claim 1, further comprising a pulley arm to connect the main pulley to the second end piece.

6. The exercise apparatus of claim 1, wherein the auxiliary pulleys rotate on a same axis as the first end piece.

7. The exercise apparatus of claim 6, wherein the plurality of pulley drums have one or more stop holes defined therein to lock the pulley drums to rotate together.

8. The exercise apparatus of claim 1, wherein the flex members are tubular structural members having a variable resistance, and further comprising a flex member rotator to rotate the flex members with respect to the first and second end pieces.

9. The exercise apparatus of claim 1, wherein the auxiliary pulleys comprise a plurality of pulley drums.

10. The resistance unit of claim 9, wherein the one or more flex members have a variable bending resistance.

11. The resistance unit of claim 9, wherein the one or more flex members comprise tubular structural members that have a directionally variable resistance.

12. The resistance unit of claim 11, further comprising a tube rotation device to rotate the tubular structural members to change the bending resistance.

13. The exercise apparatus of claim 1, wherein:

the first end piece is rotatably connected to the body on a first axis, the auxiliary pulleys rotate on a second axis, and the second axis is offset from the first axis.

14. The exercise apparatus of claim 1, wherein an axis of the main pulley and the auxiliary pulleys are offset from ends of the flex members by a predetermined axis-offset amount and offset from a neutral axis of the flex members by a predetermined neutral-axis-offset amount to provide a combination of compressive force, a couple and a bending load to flexible beam.

15. The exercise apparatus of claim 14, wherein the couple comprises a uniform bending moment throughout the flex beam.

16. The exercise apparatus of claim 14, wherein the bending load comprises a uniformly increasing bending moment that is zero at the flex beam ends and a maximum at a mid-span point of the flex beam.

17. The exercise apparatus of claim 16, wherein the maximum is equal to a cord height of a bend times a total cable tension.

18. An exercise apparatus, comprising:

a body;

a resistance unit to provide a resistance, the resistance unit comprising:

flex members;

a first end piece provided on an end of each of the flex members to rotatably secure the one end of the flex members to the body;

a second end piece provided at an other end of each of the flex members, the second end piece being within the body, the flex members being configured to bend with respect to the first end piece and the second end piece and to translate within the body;

a main pulley provided on the second end piece to rotate with respect to the second end piece; and auxiliary pulleys rotatably provided on the first end piece.

19. The exercise apparatus of claim 18, wherein the body comprises a guide area defined therein, said guide area being configured to constrain the second end piece to slideably translate.

20. An exercise apparatus, comprising:

a body;

a resistance unit to provide a resistance, the resistance unit comprising:

flex members;

a first end piece provided on an end of each of the flex members to rotatably secure the one end of the flex members to the body;

a second end piece provided at an other end of each of the flex members, the second end piece being configured to secure the flex members to bend and slideably translate within the body with respect to first end piece;

a main pulley provided on the second end piece to rotate with respect to the second end piece; and auxiliary pulleys rotatably provided on the first end piece.

* * * * *